United States Patent [19]

Lundin

[11] Patent Number: 4,793,767

[45] Date of Patent: Dec. 27, 1988

[54] DEVICE FOR PUMPING HIGHLY-VISCOUS MATERIAL, IN PARTICULAR THICK OIL

[75] Inventor: Lars Lundin, Porvoo, Finland

[73] Assignee: Oy Lars Lundin Patent AB, Finland

[21] Appl. No.: 133,111

[22] PCT Filed: Dec. 10, 1986

[86] PCT No.: PCT/FI86/00144

§ 371 Date: Oct. 8, 1987

§ 102(e) Date: Oct. 8, 1987

[87] PCT Pub. No.: WO87/03652

PCT Pub. Date: Jun. 18, 1987

[30] Foreign Application Priority Data

Dec. 13, 1985 [FI] Finland ..... 854951

[51] Int. Cl.[4] ..... F04D 3/02

[52] U.S. Cl. ..... 415/62; 415/72; 415/143; 366/266; 366/294; 366/295

[58] Field of Search ..... 415/62, 69, 71, 72, 415/73, 74, 75, 143; 366/266, 293, 294, 295

[56] References Cited

U.S. PATENT DOCUMENTS

| | | | |
|---|---|---|---|
| 2,771,036 | 11/1956 | Baez | 415/69 |
| 3,680,975 | 8/1972 | Smith et al. | 415/74 |
| 3,756,573 | 9/1973 | Sponseller | 366/294 |
| 4,197,092 | 4/1980 | Bretz | 415/72 |

FOREIGN PATENT DOCUMENTS

| | | | |
|---|---|---|---|
| 2390595 | 1/1979 | France | 415/62 |
| 681220 | 8/1979 | U.S.S.R. | 415/143 |

*Primary Examiner*—Robert E. Garrett
*Assistant Examiner*—John T. Kwon
*Attorney, Agent, or Firm*—Biebel, French & Nauman

[57] ABSTRACT

A device for pumping highly-viscous material, particularly thick oil, the device being adapted to immersion in the material and comprising a helical screw (8) and surrounding the screw a shell (9). In order to ensure the feed of the material the screw and the shell are arranged to rotate in opposite directions and to the shell are fixed outwardly-directed feeding vanes (15) and at the root of the feeding vanes on the material collection side are apertures for the delivery of the material to screw (8) rotating within the shell. The speeds of rotation of the screw and the shell can be separately adjustable.

7 Claims, 2 Drawing Sheets

DEVICE FOR PUMPING HIGHLY-VISCOUS MATERIAL, IN PARTICULAR THICK OIL

The present invention relates to a device for pumping highly-viscous material, in particular thick oil, said device being adapted to at least partial immersion in the material and comprising a rotary helical screw, and a shell surrounding said screw and being partially open to permit entry of the material, said shell being adapted to rotate in an opposite direction with respect to the screw and being provided with means for promoting feed of material towards the screw.

Screw conveyors are very well known and are employed for the transport of both fluid liquids and granular material. A conveyor of the type defined above, and particularly designed for conveying granulate material is disclosed in the SE-patent No. 322,161. In connection with e.g. escapes of oil, however, it has been observed that the handling of the oil after it has been collected into a tank requires a disproportionate expenditure of time and energy and that neither conventional liquid pumps nor screw conveyors function in a satisfactory manner in this application. In the case of conventional screw conveyors the cause is principally the fact that the flow of thick oil at low temperature is so poor that the screw very soon forms a cavity in the mass of oil within which cavity the screw rotates without raising any appreciable amount of additional material. Consequently, it is necessary to warm the collected oil several degrees which requires a disproportionate expenditure of energy and time so that this stage can often be decisive in determining the capacity of the entire oil combating operation.

The purpose of the present invention is accordingly to provide a new device based on the principle of the screw conveyor, which device is adapted to pumping thick collected oil in particular but also other materials having poor flow. The invention is characterized in that the feed promoting means comprises at least one vane attached to the shell and extending outwardly in a curved or inclined fashion so as to feed the material towards the shell as the shell rotates, and that in the shell at the foot of the feeding vane, on the collection side thereof, is an aperture for the delivery of the material to the screw within the shell.

The essential idea in the invention is thus the arrangement of forced feeding of the material to the inlet apertures of the screw. The feed vanes are preferably larger than the screw in their radial projection and are naturally dimensioned on the basis of experience so as to achieve the optimum result. For example, with a single vane its projection may be of the same order of magnitude as the diameter of the feed screw. The shell may have several vanes, but an advantageous embodiment is one having two vanes diametrically opposed. In this embodiment the rotation of the shell is balanced and there are not too many apertures, which is important for the operation of the screw conveyor. Since the shell rotates in the opposite direction with respect to the screw the oil does not appreciably escape out of the apertures. The screw and shell are preferably fitted with their own hydraulic motors which are separately adjustable as to their speed of rotation.

The invention together with its other advantages and embodiments is described in greater detail in the following by means of an example and with reference to the accompanying drawings, in which FIG. 1 shows diagrammatically a device according to the invention as seen from the side and partially sectioned; FIG. 2 shows the lower part of the device as seen from above and partially sectioned;

Figure 2:
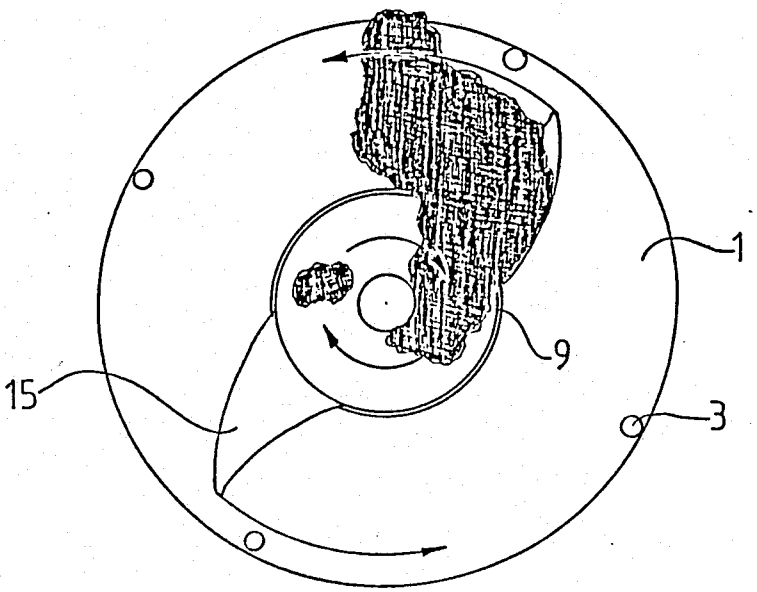
Figure 1:
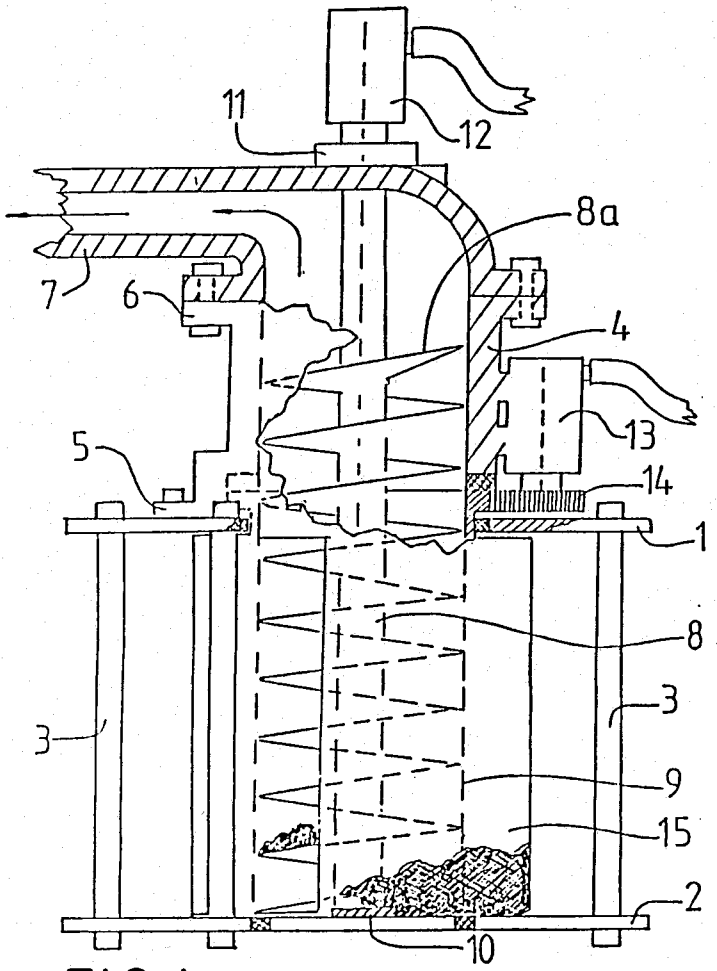
Figure 3:
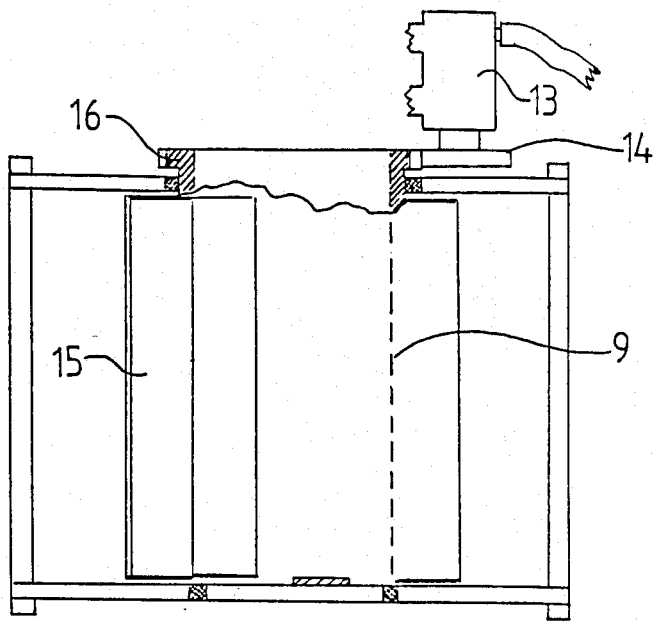
FIG. 3 shows the lower part of the device as seen from the side.

In the embodiment shown in the figures there are two circular, rigid horizontal plates 1 and 2 joined to each other by vertical rods 3 distributed around the periphery. On top of this structure is located a cylindrical extension 4 joined by a flange 5 to said upper plate 1 and by a flange 6 to an outlet pipe 7.

Within said cylindrical extension 4 is located a screw 8 comprising a central shaft and a helix **8*a* joined to said shaft in known manner. Said screw is attached centrally to lower plate 2 by a bearing 10 and to outlet pipe section 7 by a bearing 11. The screw is rotated by a hydraulic motor 12**.

Supported by plates 1 and 2 and fitted so as to be capable of rotation there is also a shell 9 surrounding said screw. The socket-shaped upper section thus forms an extension of said shell 9. The shell 9 is rotated by a hydraulic motor 13 via a gearwheel 14 and a toothed ring 16 (FIG. 4) on the periphery of the shell. Attached to shell 9 there are also two outwardly-directed scoop-shaped feeding vanes 15, which as said shell rotates collect the oil and feed it towards the shell. Screw 8 and shell 9 are rotated by motors 12 and 13 in opposite directions, as indicated by arrows in FIG. 2. Further, the speeds of motors 12 and 13 are preferably adjustable separately so that a suitable rate of feed-to the screw is obtained depending on the properties of the particular material to be pumped.

Figure 4:
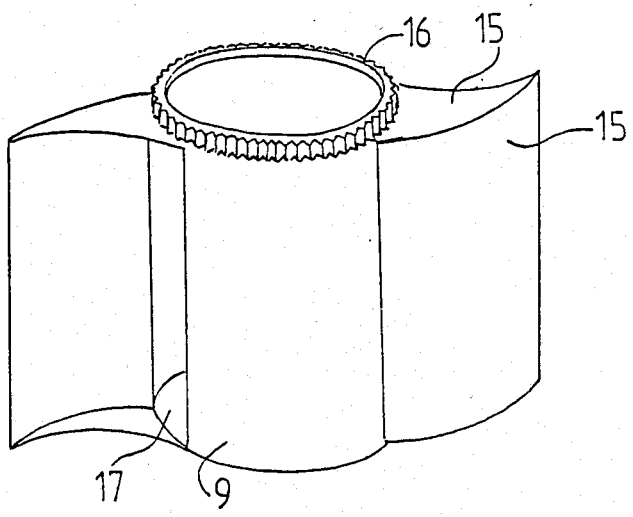
FIG. 4 shows a perspective view of the shell of the device.

The structure of the shell itself and of the feed vanes is most readily apparent from FIG. 4. The vanes 15 are fitted at their ends with stiffening plates **15*a* and are thus scoop-shaped. At the root of the vane and extending its entire length is an aperture 17 through which the material is led into the screw as shell 9** rotates.

It is obvious that the embodiment described above and shown in the figures can be modified in many ways within the concept of the invention. The feed screw and shell need not necessarily be cylindrical but could taper conically towards the top. The surrounding supporting structure could also be entirely different from the one described above formed by plates 1 and 2 and rods 3. The same applies to extension socket 4 and outlet section 7. The drive equipment of the feed screw and the shell could differ entirely from that shown in the figures, the essential point being that the shell and the screw rotate in opposite directions. The width of the slot 17 relative to the other parts of the device should naturally be chosen on the basis of experience and the slots could also be adjustable. Other details could also be varied in an appropriate fashion.

I claim:

1. A device for pumping highly-viscous material, said device being adapted to at least partial immersion in said material and comprising a rotary helical screw, and a shell surrounding said screw and being partially open to permit entry of said material, said shell being adapted to rotate in an opposite direction with respect to said screw, and provided with means for promoting feed of said material towards said screw wherein said feed promoting means comprises at least one vane attached to said shell and extending outwardly in a curved or inclined fashion so as to feed said material towards said shell as said shell rotates, and that in said shell at the foot of each feeding vane, on the collection side thereof, is an aperture for delivery of said material to said screw within said shell.

2. The device of claim 1 wherein the speeds of rotation of said screw and said shell are separately adjustable.

3. The device of claim 1 wherein said feeding vanes are curved in the direction of their rotation and closed at least at one end by a plate in order to stiffen them.

4. The device of claim 2 wherein said feeding vanes are curved in the direction of their rotation and closed at least at one end by a plate in order to stiffen them.

5. The device of claim 9 wherein said device comprises two diametrically-opposed feeding vanes.

6. The device of claim 1 wherein said shell is located between essentially horizontal top and bottom structures wherein said structures are joined together by vertical rods situated outside said shell.

7. The device of claim 2 wherein the drive motors of said screw and s aid shell are hydraulic motors.

* * * * *

UNITED STATES PATENT AND TRADEMARK OFFICE

CERTIFICATE OF CORRECTION

PATENT NO. : 4,793,767

DATED : December 27, 1988

INVENTOR(S) : Lars Lundin

It is certified that error appears in the above-identified patent and that said Letters Patent is hereby corrected as shown below:

Claim 5, line 1, "claim 9" should be --claim 1--.

Signed and Sealed this

Second Day of May, 1989

*Attest:*

DONALD J. QUIGG

*Attesting Officer*

*Commissioner of Patents and Trademarks*